US007518052B2

(12) United States Patent
Kourbatov

(10) Patent No.: US 7,518,052 B2
(45) Date of Patent: Apr. 14, 2009

(54) MUSICAL THEME SEARCHING

(75) Inventor: Alexei Kourbatov, Bellevue, WA (US)

(73) Assignee: Microsoft Corporation, Redmond, WA (US)

( * ) Notice: Subject to any disclaimer, the term of this patent is extended or adjusted under 35 U.S.C. 154(b) by 128 days.

(21) Appl. No.: 11/384,061

(22) Filed: Mar. 17, 2006

(65) Prior Publication Data

US 2007/0214941 A1 Sep. 20, 2007

(51) Int. Cl.
*G10H 1/00* (2006.01)

(52) U.S. Cl. ..... 84/609; 84/649; 84/600

(58) Field of Classification Search ..... 84/600–602, 84/609, 649

See application file for complete search history.

(56) References Cited

U.S. PATENT DOCUMENTS

| | | | | |
|---|---|---|---|---|
| 5,402,339 | A * | 3/1995 | Nakashima et al. | 707/1 |
| 5,739,451 | A * | 4/1998 | Winksy et al. | 84/609 |
| 5,963,957 | A * | 10/1999 | Hoffberg | 707/104.1 |
| 6,188,010 | B1 * | 2/2001 | Iwamura | 84/609 |
| 6,307,139 | B1 * | 10/2001 | Iwamura | 84/601 |
| 6,528,715 | B1 * | 3/2003 | Gargi | 84/615 |
| 6,678,680 | B1 * | 1/2004 | Woo | 707/6 |
| 6,967,275 | B2 * | 11/2005 | Ozick | 84/616 |
| 6,995,309 | B2 * | 2/2006 | Samadani et al. | 84/603 |
| 2002/0073098 | A1 * | 6/2002 | Zhang et al. | 707/104.1 |
| 2003/0023421 | A1 * | 1/2003 | Finn et al. | 704/1 |
| 2004/0030691 | A1 * | 2/2004 | Woo | 707/3 |
| 2007/0162497 | A1 * | 7/2007 | Pauws | 707/104.1 |
| 2007/0163425 | A1 * | 7/2007 | Tsui et al. | 84/609 |

OTHER PUBLICATIONS

Fogwall, N., The search for a notation index, located at www.af.lu.se/~fogwall/notation.html, last accessed Apr. 4, 2006.

Ghias, A., J. Logan, and D. Chamberlin, Query by humming: Musical information retrieval in an audio database, Proceedings of the 3rd ACM Int'l conference on Multimedia, Nov. 5-9, 1995, San Francisco, p. 231-236.

Lu, L., H. Yu, H.-J. Zhang, A new approach to query by humming in music retrieval, *Proceedings of the IEEE Int'l Conference on Multimedia and Expo*, 2001.

Musipedia: The Open Music Encyclopedia, located at www.musipedia.org, last accessed Apr. 6, 2006.

ParfaitOlé Melody Search Engine, located at www.parfaitole.com, last accessed Apr. 6, 2006.

Shazam, located at www.shazam.com, last accessed Apr. 4, 2006.

Themefinder, located at themefinder.com, last accessed Apr. 6, 2006.

Tunespotting—The Melody Search Engine, located at www.tunespotting.com, last accessed Apr. 4, 2006.

* cited by examiner

*Primary Examiner*—David S. Warren
(74) *Attorney, Agent, or Firm*—Lyon & Harr, LLP; Richard T. Lyon

(57) ABSTRACT

A musical information retrieval system and process is presented. The system and process generally involves a user employing a unique graphic user interface (GUI) to enter a musical theme query, which is then characterized using a special normalized format. The characterized musical query is then compared in a variety of ways to similarly characterized musical themes resident in a database to identify one or more matching themes. The matching theme or themes are then reported to the user.

18 Claims, 7 Drawing Sheets

MUSICAL THEME SEARCHING

BACKGROUND

Consider a scenario where a person would like to identify a piece of music that has a distinctive theme. The person remembers this musical theme very well; however, may not know the title, or composer, or its country of origin, or its key signature, or any similar identifying characteristic. Further, the person cannot write down the music because he or she does not know musical notation.

One possible recourse for this person would be to consult a book of musical themes. Originally, these books required the ability to read/write music in order to find a piece of music and so would not be helpful to a non-musician. However, some books characterize musical themes using the Parsons code, also known as melody contour or rough contour. Generally, this code is a representation of the melody of a musical theme that only requires the reader to know whether the pitch of each consecutive note in the theme is higher, lower or the same as the last note. The drawback to this is that even very different musical themes can exhibit identical or similar contours, and so a search by contour alone often produces multiple "false positives" or requires unreasonably long queries.

Another option available to the aforementioned person wanting to identify a piece of music is to employ a computer-based musical information retrieval system. In general, these systems involve a user making a query that represents the musical theme being sought via some type of user interface. The input is typically characterized in some manner and then compared to a database of similarly characterized musical themes in an attempt to find a match. The system then reports the matching theme(s) to the user. For example, the matching theme title(s) could be displayed to the user on a computer monitor screen.

The user interfaces employed in these conventional musical information retrieval systems vary greatly. Most employ some form of a graphical user interface that a user employs to enter information about the theme. For example, a user might be required to enter notes onto a representation of a musical staff. Thus, the user would need to know how to write music. Another example might involve a user entering a Parsons code representation of the musical theme being sought. Yet another example might involve the user humming the theme which is captured via a microphone.

In regard to the content databases employed in musical information retrieval systems, most store music as musical score-based (or note-based) information in one of several widely known encoding formats, such as MIDI, MusicXML, MuseData and Humdrum. Unfortunately, these encoding formats do not lend themselves to efficient theme searching. As a result, some systems employ more search-friendly characterizations of the stored musical themes. For example, pitch characterizations including the Parsons code are often used. Thus, queries by a user are first characterized in the same manner as the stored musical themes before being compared.

SUMMARY

A computer-implemented musical information retrieval system and process is presented. The system and process generally involves a user employing a unique graphic user interface (GUI) to enter a musical theme query, which is then characterized using a special normalized format. The characterized musical query is then compared in a variety of ways to similarly characterized musical themes resident in a database to identify one or more matching themes. The matching theme or themes are then reported to the user.

The GUI employs a display, user interface selection device and user interface data entry device. In general, an image of a piano-type keyboard is displayed to a user on the display. Each time the user selects a key of the displayed keyboard via the selection device, the musical note corresponding to that key is recorded. In addition, each time the user selects a key, the time since the immediately preceding key selection is recorded as the duration of the immediately preceding note. In this way, both the pitch and duration of each note are captured in a one-click-per-note input process.

The characterization of a sequence of musical notes making up a musical query and each of the musical themes resident in the database generally involves characterizing both the melody and rhythm of the sequence. The melody is characterized based on a digital representation of the pitch of each note, and the rhythm is characterized based on a digital representation of the duration of each note.

In regard to the melody characterization, one embodiment involves assigning a digital representation of the number zero to the first note of the sequence. Then, for each note of the sequence after the first note, a digital representation of an integer number signifying the pitch difference of the note with respect to the first note is assigned. More particularly, the difference in pitch between a note in the sequence and the first note is computed in terms of the number of semi-tones separating the notes. A digital representation of an integer number equal to the number of semi-tones separating the notes is then assigned to the note under consideration. If the note under consideration has a higher pitch than the first note, this integer number is positive. If the note has a lower pitch than the first, the integer number is negative. And, if the note under consideration has the same pitch as the first note, the integer number is a zero.

In regard to the rhythm characterization, one embodiment involves assigning a digital representation of a prescribed base integer number to the shortest duration note or notes. The shortest duration notes are defined as being the shortest within a prescribed tolerance. For notes in the sequence exhibiting a longer duration compared the shortest duration note or notes, a digital representation of an integer number signifying the note duration is assigned, which equals the base number multiplied by the ratio of the duration of the note under consideration to the duration of one of the shortest duration note or notes, and rounded to the nearest integer.

The comparison of musical query characterized in the manner described above to similarly characterized musical themes resident in the database in order to identify one or more matching themes generally involves the musical information retrieval system first inputting the characterized musical query from a user. The query is then compared to musical themes resident in the database and matching themes are reported to the user. In one embodiment, this comparison first entails determining if a match exists between the digital representation of the pitch of each note of the musical query and at least a portion of the digital representation of the pitch of each note of a musical theme resident in the database. This is repeated for each theme, and those themes found to match the musical query are designated as such. In one version of the comparison, an exact byte-by-byte correspondence between the query and at least a portion of a stored theme is needed to qualify as a match. However, in an alternate version, those musical themes resident in the database that have no more than a prescribed number of bytes in at least a portion thereof that do not match the bytes of the musical query are designated as matching. The comparison also involves determining if a match exists based on the durations of the notes. In one version of the comparison, a dot-product similarity measure is computed between the digital representation of the duration of each note of the musical query and at least a portion of the digital representation of the duration of each note of a musical theme resident in the database. This can be repeated for all themes in the database, or just those designated as matches in the pitch-based comparison. Those musical themes that are found to have a similarity measure in relation to the query which exceeds a prescribed threshold are designated as matching.

Matching themes can be reported to the user in a variety of ways. In general, whenever no matching themes are identified, this is reported to the user. However, whenever one or more matching themes are identified, information about each matching musical theme is reported to the user. This information includes the name of each matching musical theme, and in one embodiment involves providing the names in an order indicative of the degree to which the musical theme matched the query, with the closest matching themes being provided first.

It is noted that while the foregoing limitations in existing musical information retrieval schemes described in the Background section can be resolved by a particular implementation of the system and process according to the present invention, this system and process is in no way limited to implementations that just solve any or all of the noted disadvantages. Rather, the present system and process has a much wider application as will become evident from the descriptions to follow.

It should also be noted that this Summary is provided to introduce a selection of concepts, in a simplified form, that are further described below in the Detailed Description. This Summary is not intended to identify key features or essential features of the claimed subject matter, nor is it intended to be used as an aid in determining the scope of the claimed subject matter. In addition to the just described benefits, other advantages of the present invention will become apparent from the detailed description which follows hereinafter when taken in conjunction with the drawing figures which accompany it.

DESCRIPTION OF THE DRAWINGS

The specific features, aspects, and advantages of the present invention will become better understood with regard to the following description, appended claims, and accompanying drawings where:

DETAILED DESCRIPTION

In the following description of embodiments of the present invention reference is made to the accompanying drawings which form a part hereof, and in which are shown, by way of illustration, specific embodiments in which the invention may be practiced. It is understood that other embodiments may be utilized and structural changes may be made without departing from the scope of the present invention.

1.0 The Computing Environment

Before providing a description of embodiments of the present musical information retrieval system and process, a brief, general description of a suitable computing environment in which portions of the system and process may be implemented will be described. The musical information retrieval system is operational with numerous general purpose or special purpose computing system environments or configurations. Examples of well known computing systems, environments, and/or configurations that may be suitable for use with the present system include, but are not limited to, personal computers, server computers, hand-held or laptop devices, multiprocessor systems, microprocessor-based systems, set top boxes, programmable consumer electronics, network PCs, minicomputers, mainframe computers, distributed computing environments that include any of the above systems or devices, and the like.

Figure 1:
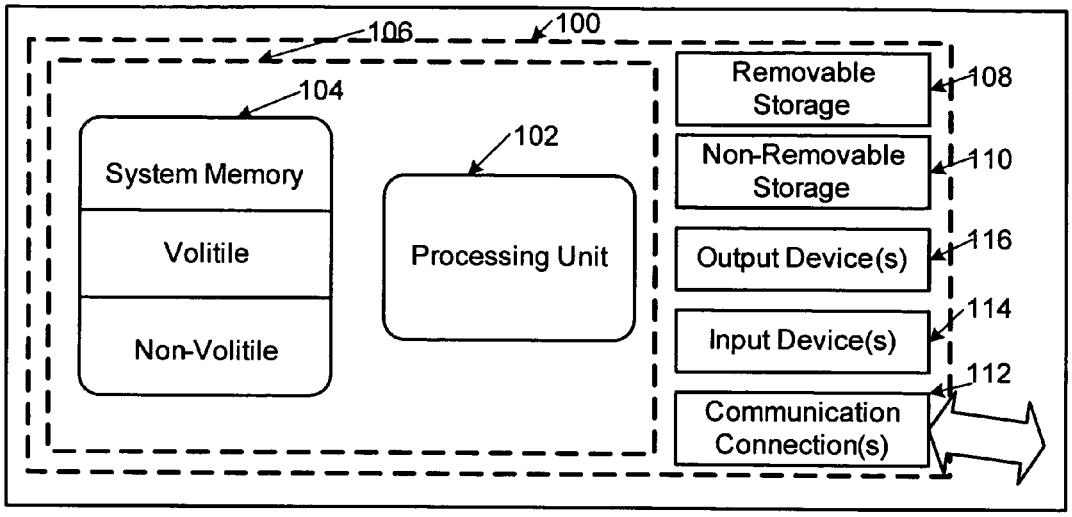
FIG. 1 is a diagram depicting a general purpose computing device constituting an exemplary system for implementing the present invention.

FIG. 1 illustrates an example of a suitable computing system environment. The computing system environment is only one example of a suitable computing environment and is not intended to suggest any limitation as to the scope of use or functionality of the present musical information retrieval system and process. Neither should the computing environment be interpreted as having any dependency or requirement relating to any one or combination of components illustrated in the exemplary operating environment. With reference to FIG. 1, an exemplary system for implementing the present musical information retrieval system includes a computing device, such as computing device 100. In its most basic configuration, computing device 100 typically includes at least one processing unit 102 and memory 104. Depending on the exact configuration and type of computing device, memory 104 may be volatile (such as RAM), non-volatile (such as ROM, flash memory, etc.) or some combination of the two. This most basic configuration is illustrated in FIG. 1 by dashed line 106. Additionally, device 100 may also have additional features/functionality. For example, device 100 may also include additional storage (removable and/or non-removable) including, but not limited to, magnetic or optical disks or tape. Such additional storage is illustrated in FIG. 1 by removable storage 108 and non-removable storage 110. Computer storage media includes volatile and nonvolatile, removable and non-removable media implemented in any method or technology for storage of information such as computer readable instructions, data structures, program modules or other data.

Memory 104, removable storage 108 and non-removable storage 110 are all examples of computer storage media. Computer storage media includes, but is not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, or any other medium which can be used to store the desired information and which can accessed by device 100. Any such computer storage media may be part of device 100.

Device 100 may also contain communications connection(s) 112 that allow the device to communicate with other devices. Communications connection(s) 112 is an example of communication media. Communication media typically embodies computer readable instructions, data structures, program modules or other data in a modulated data signal such as a carrier wave or other transport mechanism and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared and other wireless media. The term computer readable media as used herein includes both storage media and communication media.

Device 100 may also have input device(s) 114 such as a keyboard and voice input device for data entry, and a mouse, pen, and touch input device for use in selecting displayed items, among other devices. Output device(s) 116 such as a display, speakers, printer, etc. may also be included. All these devices are well know in the art and need not be discussed at length here.

The present musical information retrieval process may be described in the general context of computer-executable instructions, such as program modules, being executed by a computing device. Generally, program modules include routines, programs, objects, components, data structures, etc. that perform particular tasks or implement particular abstract data types. The present musical information retrieval system and process may also be practiced in distributed computing environments where tasks are performed by remote processing devices that are linked through a communications network. In a distributed computing environment, program modules may be located in both local and remote computer storage media including memory storage devices.

The exemplary operating environment having now been discussed, the remaining parts of this description section will be devoted to a description of the program modules embodying the present musical information retrieval system and process.

2.0 Musical Information Retrieval System and Process

The present musical information retrieval system and process generally involves a user employing a unique graphic user interface (GUI) to enter a musical theme query, which is then characterized using a special normalized format. The characterized musical query is then compared in a variety of ways to similarly characterized musical themes resident in a database to identify one or more matching themes. The matching theme or themes are then reported to the user, who can play any of them desired. It is noted that a musical theme is generally defined for the purposes of this description as a sequence of notes having a melody and rhythm which are indicative of a particular piece of music.

Each of the aspects of the present system and process will now be described in more detail in the sections to follow.

2.1 One-Click-Per-Note GUI

Figure 2:
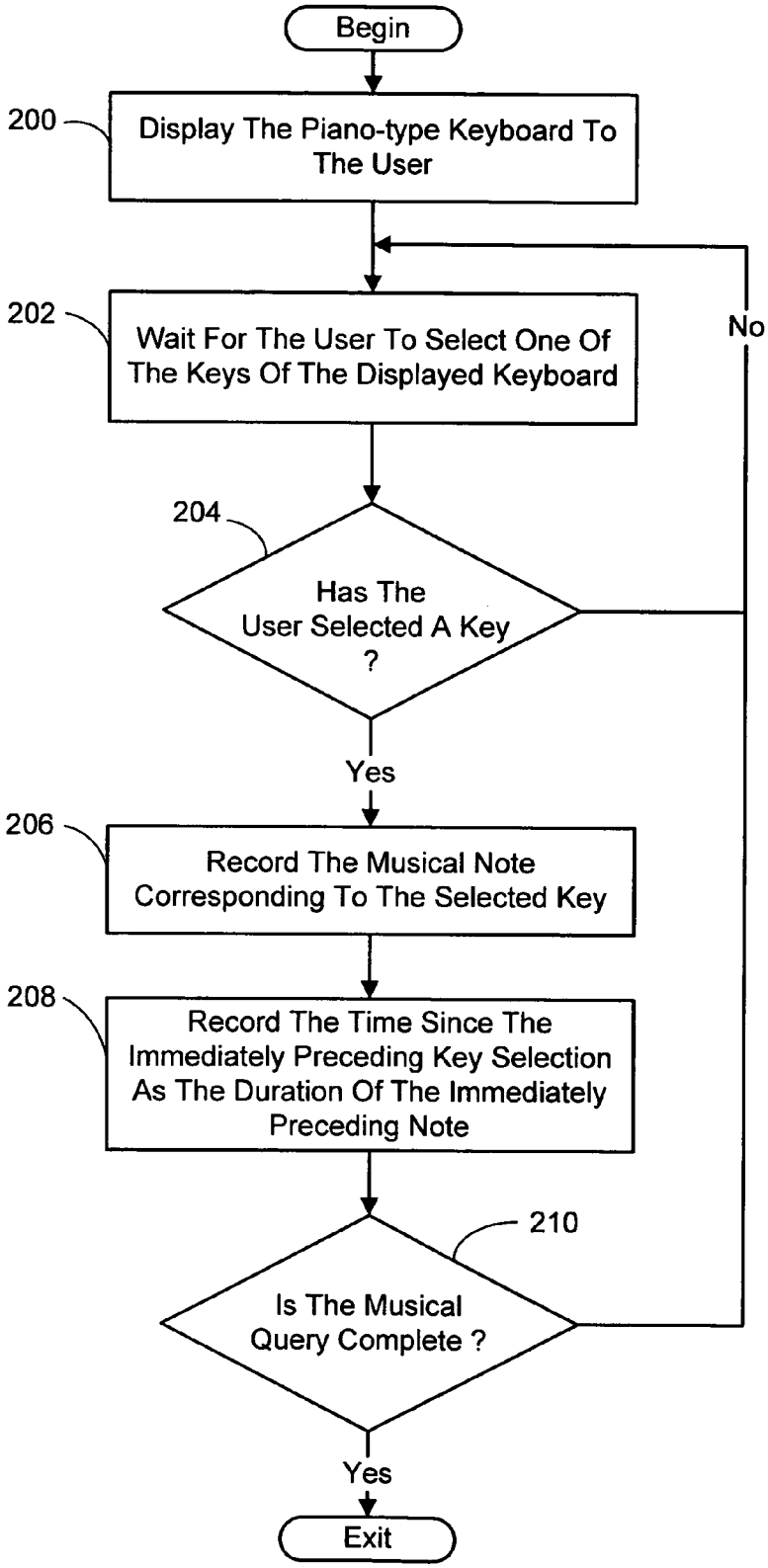
FIG. 2 is a flow chart diagramming a generalized process for capturing information about a musical theme query from a user via a graphic user interface.

The user of the present musical information retrieval system and process employs the aforementioned GUI to enter a musical theme query. This GUI uses a computing system, such as the ones described previously in connection with the computing environment, and generally includes a display, user interface selection device and user interface data entry device. The GUI also employs an information capturing process to facilitate the user's entry of a musical query. Referring to FIG. 2, this process generally involves displaying an image of a piano-type keyboard to a user on the display (process action 200). The system then waits for the user to select one of the keys of the displayed keyboard via the selection device (process action 202). Whenever it is determined the user selects a key (process action 204), the musical note corresponding to the selected key is recorded (process action 206). In addition, whenever the user selects a key, the time since the immediately preceding key selection is recorded as the duration of the immediately preceding note (process action 208). It is then determined if the user has indicated that the input of musical notes making up the query is complete (process action 210). If so, the process ends. Otherwise, the system then returns to waiting for the next key selection.

Figure 3:
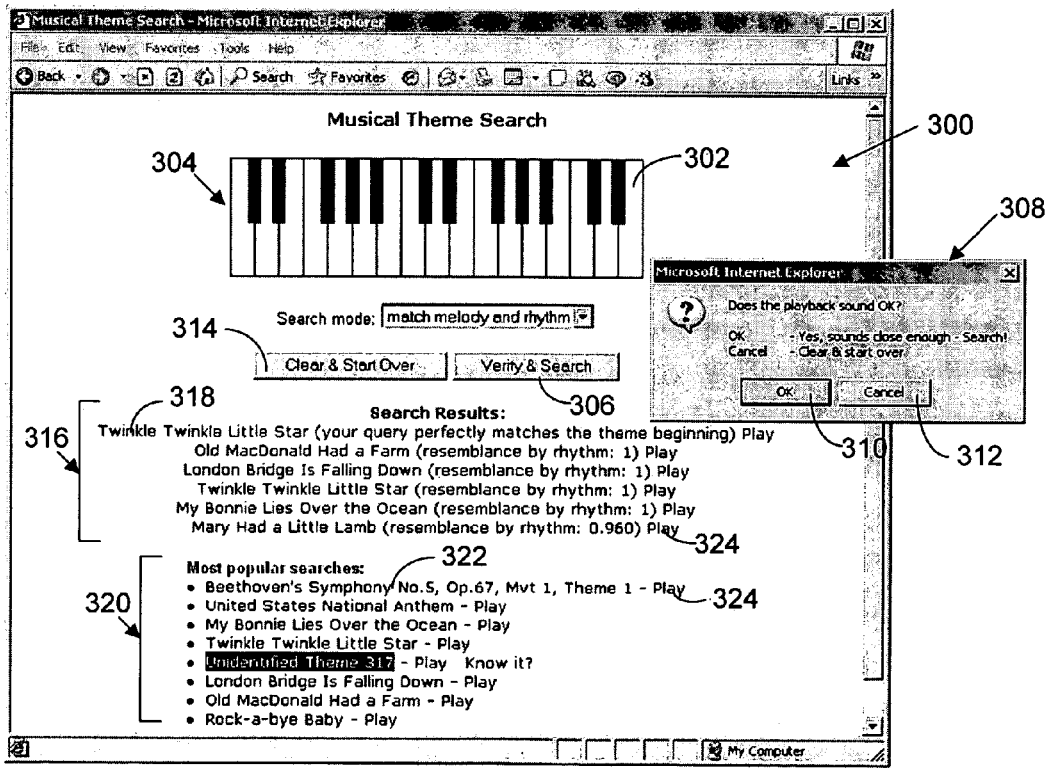
FIG. 3 shows an example of a musical theme search window that the user can employ to enter information about a musical theme query and obtain search results.

The aforementioned display of the image of a piano-type keyboard more particularly involves displaying a schematic depiction of a piano keyboard in a "Musical Theme Search" window shown on the user's display screen. An example of the Search window 300 is depicted in FIG. 3. It is noted that the depicted window is just an example, and other configurations can also be employed.

In general, the user selects a key 302 on the keyboard 304 in any conventional manner to "play" a corresponding note. As the user selects the sequence of notes making up the desired musical theme both its melody (via pitch) and rhythm (via timing) are captured. In addition, the respective notes are played back via an audio output as the user selects keys 302 on the displayed keyboard 304. Thus, the interface provides a one-click-per-note input of the musical theme. All that is needed is a rudimentary knowledge of a piano keyboard, much of which can be gleaned by a novice by simply listening to the notes as they are played. Further, the user can playback the entire theme once it is entered. In the example Search window 300 shown in FIG. 3, this is accomplished by selecting the "Verify and Search" button 306. The previously enter notes are played back and a pop-up window 308 appears asking the user if the playback "sounds OK". If so, the user selects the "OK" button 310 in the pop-up window 308 and the search is initiated. If the playback was not satisfactory, the user selects a "Cancel" button 312 in the pop-up window 308 and the pop-up disappears. The user can then start over with the query input. To skip the verification stage altogether and start a new query immediately, the user selects the "Clear & Start Over" button 314 in the example Search window 300 of FIG. 3. When the user is satisfied with what was entered, he or she initiates a search, as described above.

In an optional embodiment of the GUI, the user can also make corrections to the previous query by retaining only a portion thereof.

In another optional embodiment of the GUI, the user also has the ability to enter information that may be known about the musical theme being sought. For example, information such as a theme's genre, country of origin, title, author(s), theme name, key signature, time signature, and so on, can be entered by the user. This information is added to the query as meta-data.

Before the search can begin, the user's musical query is characterized using a unique normalized format which provides for fast and efficient searches. The aforementioned database that is to be searched contains musical themes that have been characterized using the same normalized format. This format and the searching procedure will be described in more detail in the sections to follow. It is noted that the present musical information retrieval system and process can be implemented on a single computing device, or can be implemented in a client-server fashion in a computer network where the server accesses the database and queries are sent from a client over the network to the server. For example, in the latter context, a user could employ a web browser to open a website via the Internet that provides the present musical information retrieval system. The user would initiate the system from the website and a web page would open that corresponds to the above-described GUI. This procedure can also include a download of a program needed to characterize the user's musical query and perform the functions of the GUI. Otherwise, the raw user inputs would be sent to the server, which would update the web page accordingly and characterize the musical query at the appropriate time.

Once a search is complete, the results are provided to the user via the Search window 300 in a "search results" sector 316, as shown in FIG. 3. The results can be provided in many forms as will be described later. However, generally, the search results sector will either indicate that no matching musical theme was found, or one or more matching musical themes will be listed. If musical themes 318 are listed, in one embodiment exemplified in FIG. 3, they are listed by name. In addition, other information about the search results or matching musical themes can be provided. For example, the degree of matching could be presented. Further, if the degree of matching is provided, the matching musical themes can be listed in order of the degree of matching from highest to lowest, with themes having an equal degree being listed randomly or alphabetically by name. Another item that could be presented to the user in the search results sector when matching musical themes are listed is a link to further information about the theme.

In another optional embodiment of the GUI, information about the most popular searches made by the user and/or other users in the past are displayed in a "most popular searches" sector 320 of the Search window 300, as shown in FIG. 3. In one version of this embodiment, the musical themes 322 most often returned as search results in the order of the frequency of their appearance would be listed by name up to some prescribed number (e.g., the top 10) and dependent on the space available.

In yet another optional embodiment of the GUI, the user also has the ability to play any musical theme listed in the results sector, or in the most popular searches sector (if present). This feature can be implemented in any conventional way using the GUI, such as with a button, drop-down menu, and so on. In the example Search window 300 shown in FIG. 3, this feature is implemented by appending the word "play" 324 to each musical theme listed. The user selects the word to initiate a playback of the musical theme. A more detailed description of this feature will be provided in the sections to follow.

2.2 Normalized Format

Figure 4:
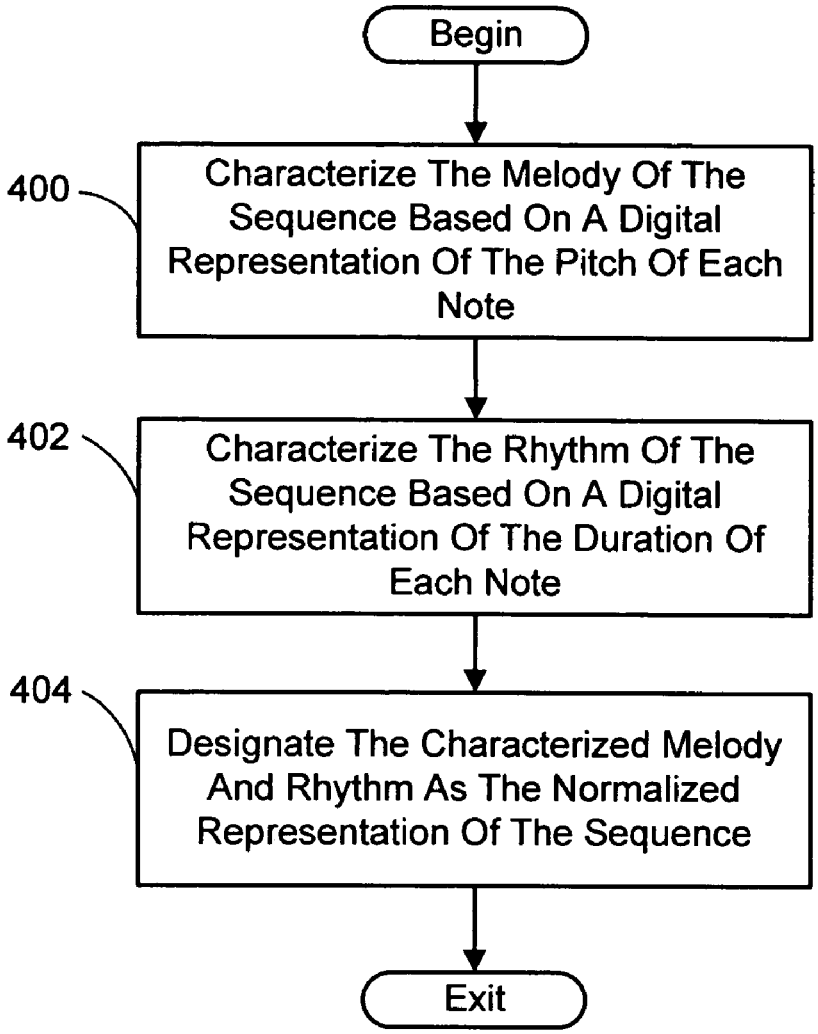
FIG. 4 is a flow chart diagramming a generalized process for characterizing a musical theme query or stored musical themes in a normalized format.

Referring to FIG. 4, one embodiment of a process for characterizing a user's musical theme queries and the musical themes stored in the search database using the aforementioned normalized format generally involves characterizing the melody of the sequence of musical notes making up the query or stored theme based on a digital representation of the pitch of each note (process action 400), where identical pitches within the sequence have the same digital representations, different pitches have different digital representations, and the pitch of the very first note in sequence is represented as a zero. In addition, the rhythm of the sequence of musical notes is characterized based on a digital representation of the duration of each note (process action 402). The characterized melody and rhythm are then designated as the normalized format representation of the sequence (process action 404).

More particularly, the user's musical theme queries and the musical themes stored in the search database are characterized by defining each musical theme by the individual note pitches relative to the first note in the theme, as well as relative durations with respect to the shortest duration in the input rhythmic pattern. Both the relative pitches and durations are converted to small integers which can be represented digitally (e.g., as one byte per pitch and one byte per duration). This provides a very economical, yet musically meaningful, format for theme characterization.

Figure 9:
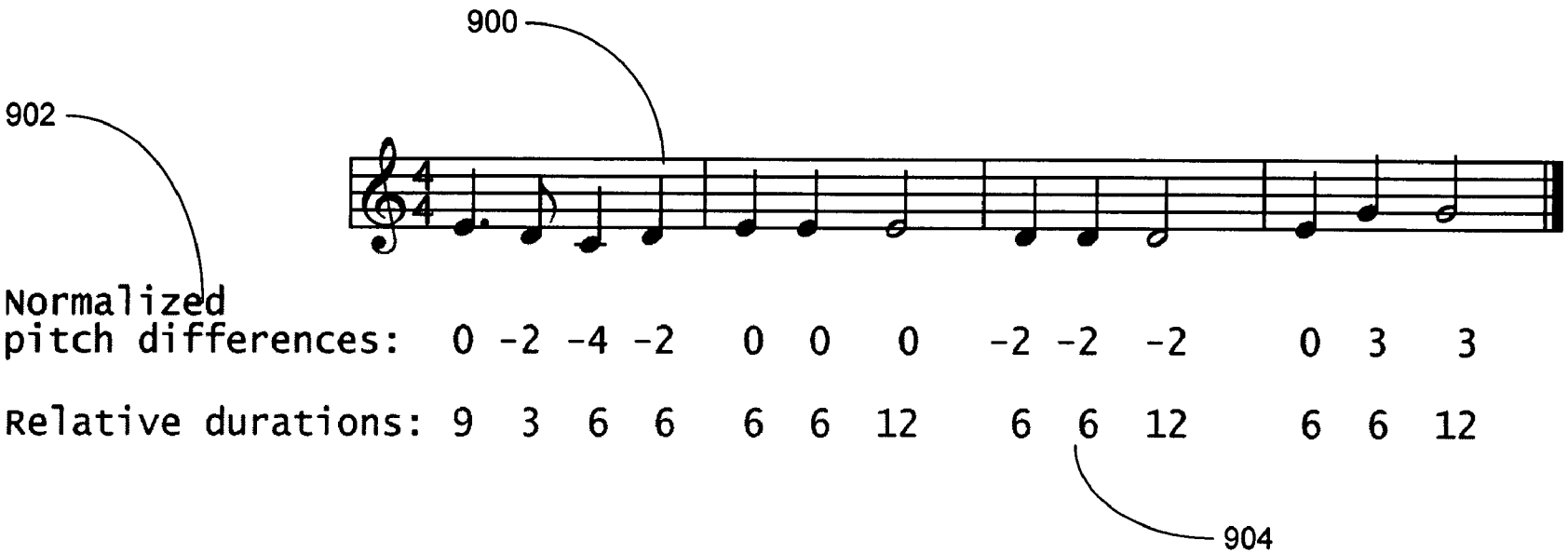
FIG. 9 is diagram exemplifying how the first 13 notes the song "Mary Had A Little Lamb" would be characterized using normalized relative pitch differences and durations according to one embodiment of the present system and process.

In regard to the normalized pitch format, integer numeric representations of relative pitch differences with respect to the first note are generated for each note, with the first note being set to 0. The difference in pitch between a note being characterized and the first note is measured in the number of semi-tones it differs from the first note. For example, if the note under consideration has a pitch that is 3 semi-tones lower than the first note, it would be characterized as a −3, and if it has a pitch that was 3 semi-tones higher than the first note it would be characterized by the number 3. Given this format, by way of an example, the first 13 notes 900 of the song "Mary Had A Little Lamb" would be characterized by normalized pitch differences as 0,−2,−4,−2, 0, 0, 0,−2,−2,−2,0,3,3 (902) as shown in FIG. 9.

Figure 5:
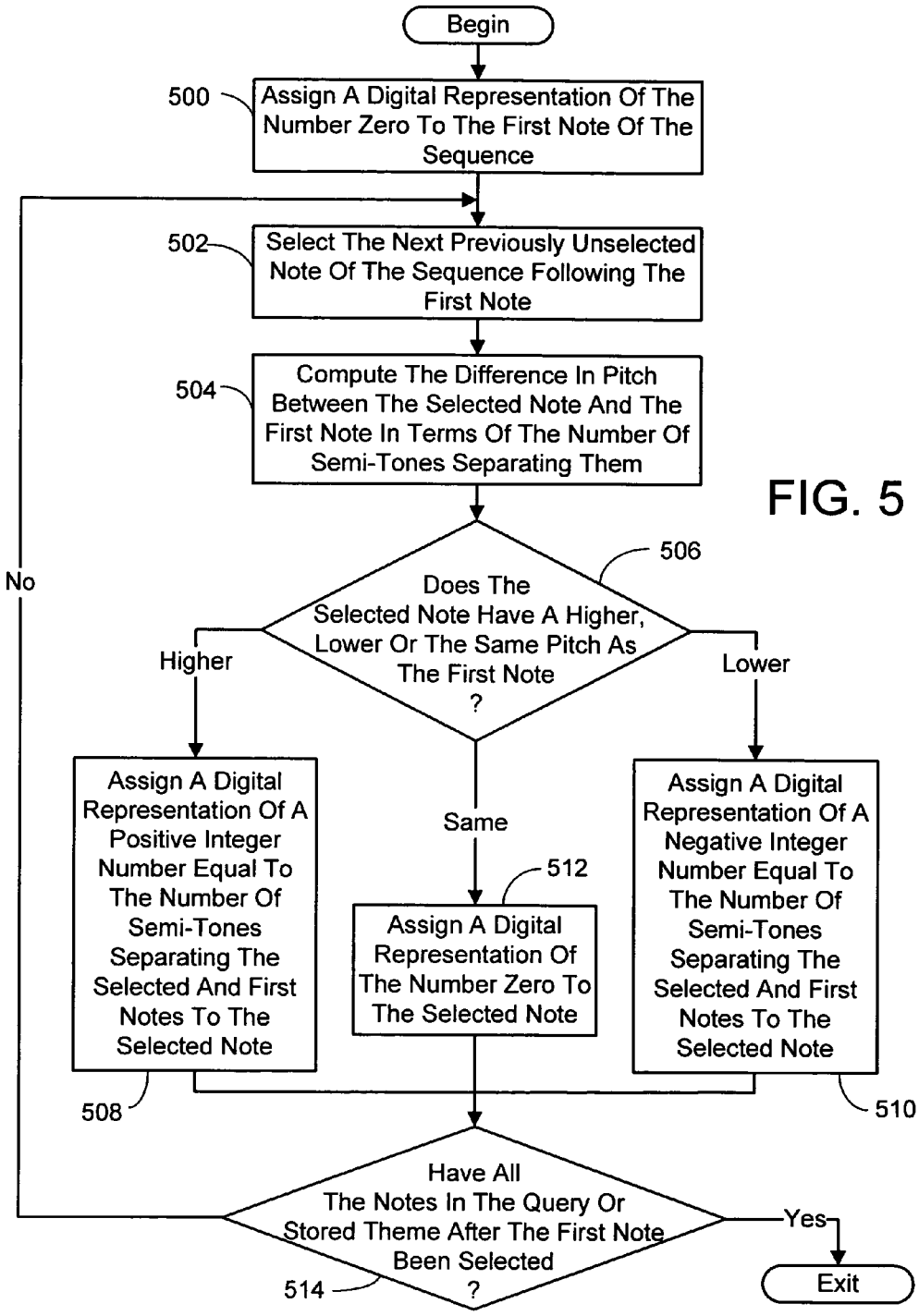
FIG. 5 is a flow chart diagramming one embodiment of a pitch-based process for characterizing the melody of a musical theme query or stored musical theme as part of generating the normalized format.

One embodiment of a process for characterizing the melody of the sequence of musical notes making up a musical query or a stored theme that implements the foregoing normalized pitch format in outlined in FIG. 5. First, a digital representation of the number zero is assigned to the first note of the sequence making up the query or stored theme (process action 500). The next previously unselected note of the sequence following the first note is then selected (process action 502) and the difference in pitch between the selected note and the first note in terms of the number of semi-tones separating them is computed (process action 504). Next, it is determined if the selected note has a higher, lower or the same pitch as the first note (process action 506). If the selected note has a higher pitch, a digital representation of a positive integer number equal to the number of semi-tones separating the selected and first notes is assigned to the selected note (process action 508). If the selected note has a lower pitch, a digital representation of a negative integer number equal to the number of semi-tones separating the selected and first notes is assigned to the selected note (process action 510). And, if the selected note has the same pitch as the first note, a digital representation of the number zero is assigned to the selected note (process action 512). It is then determined if all the notes in the query or stored theme after the first have been selected (process action 514). If not, process actions 502 through 514 are repeated, until all the notes have been processed, at which point the process ends.

The normalized rhythm format involves the use of numerical representations to represent the duration of each note relative to the shortest note duration in the theme. In this latter case, the numerical representation of the shortest duration in the theme is chosen to be a small integer number such that multiples of the number approximately described the relative duration between the other notes in the theme.

Figure 6:
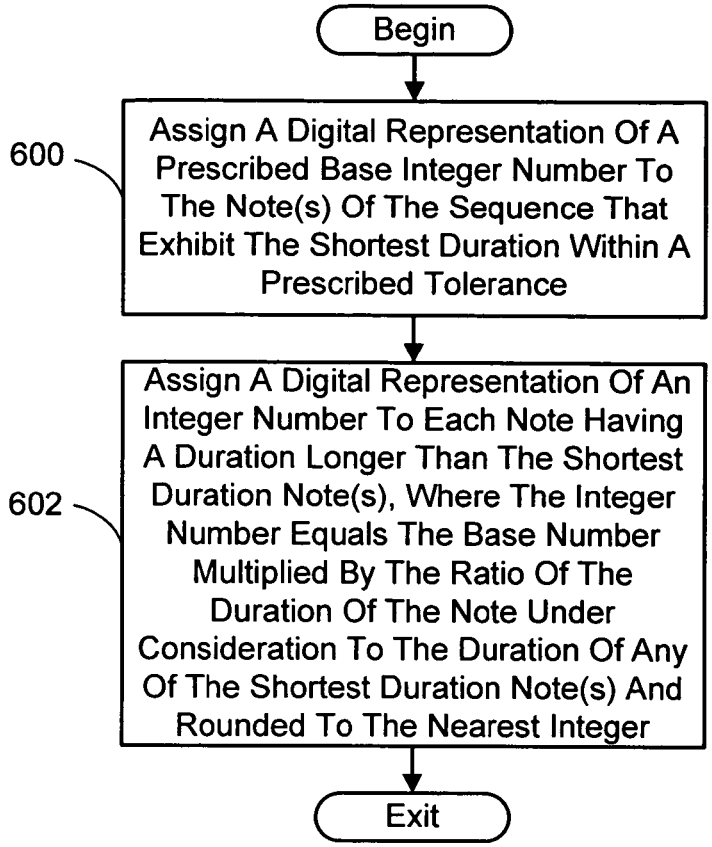
FIG. 6 is a flow chart diagramming one embodiment of a duration-based process for characterizing the rhythm of a musical theme query or stored musical theme as part of generating the normalized format.

One way of implementing this characterization of the rhythm of a musical query and the stored themes is outlined in FIG. 6. First, a digital representation of a prescribed base integer number is assigned to the note or notes of the sequence of notes making up the query or stored theme that exhibit the shortest duration within a prescribed tolerance (process action 600). Approximations of the actual durations of the shortest duration notes can be used because there will be some natural variability in the entered data.

Once the shortest duration notes have been assigned the base number, in process action 602, a digital representation of an integer number is assigned to each note having a duration longer than the shortest duration note or notes, where this integer number equals the base number multiplied by the ratio of the duration of the note under consideration to the duration of any of the shortest duration note or notes, and rounded to the nearest integer.

For example, suppose the shortest note duration in a theme is approximately 600 milliseconds and the other note durations are multiples of that duration (as they would typically be in a musical theme) such as approximately 1200 and 1800 milliseconds. In such a case, the 600 millisecond note would be represented by a small base integer, the 1200 millisecond note would be represented by an integer that is twice the base integer and the 1800 millisecond note would be represented by an integer that is three times the base integer. It is noted while the base integer in the foregoing simplistic example could be set to 1, the note durations in real musical themes tend to be more varied and often represent fractional multiples of the shortest duration. For example, durations of 4/3 and 3/2 of the shortest note duration are common in music. Accordingly, to ensure that each note's duration can be represented by an integer number, a larger base number will typically be appropriate. In tested embodiments, it was found that a base number of 6 was able to account for most duration differences using integer numbers. For instance, in the example above if a note had a duration approximately 4/3 of the shortest duration note (which is represented by a 6), its duration would be represented as 8. Similarly, if a note had a duration of approximately 3/2 of the shortest duration note, its duration would be represented as 9. It is noted that the use of 6 as the base number is only one possibility. Some musical themes may have more complex duration patterns and require an even larger base number to ensure notes having a duration that is a fractional multiple of the shortest duration can be represented by an integer multiple of the base number. On the other hand, some musical themes may be able to be characterized using a smaller base number all the way down to 1 as in the simplistic example provided above.

Given the foregoing, by way of an example, the first 13 notes 900 of the song "Mary Had A Little Lamb" would be characterized by relative durations as 9,3,6,6,6,6,12,6,6,12,6, 6,12 (904) where 3 is the base number, as shown in FIG. 9.

The foregoing compact normalized format for storing and searching has many advantages. For example, the normalized pitch format is transposition-invariant, meaning the user does not need to know the key of the theme being sought. Thus, the representation of notes EEEC in a search query will match the representation of notes AAAF in the search database as both will be characterized with regard to pitch as bytes representing 0,0,0,−4. In addition, the normalized duration format can be tempo-invariant if a dot-product-based similarity measure is employed, as will be described shortly. For example, if the user enters the notes of a musical query with the correct relative note durations, but at a slower tempo than the actual musical theme stored in the search database, the dot-product-based similarity measure between the two will still be very high.

Still further, since all relative pitches and durations in the normalized format are represented as small integers, they all can be stored as one-byte numbers. (Signed bytes can be used for relative pitches, and unsigned bytes for relative durations.) Thus, the system can store very large numbers of themes in a relatively small amount of memory space. This in turn allows not only for quick and reliable searches, but also for long-term storage of user queries. The latter is significant because retaining past user queries affords an opportunity for compiling the aforementioned most popular searches lists. To this end, the present musical information retrieval system and process can include an optional feature where the user is provided with a list of the most popular searches as mentioned earlier in connection with the GUI description. In the context of a server-client implementation, the server would compile the list based on search queries received from multiple users. In one version of this embodiment, the musical themes most often returned as search results would be provided in the order of the frequency of their appearance up to some prescribed number (e.g., the top 10).

In addition, post-identification and post-attribution of unknown themes becomes possible because each query contains enough information for recognizable playback. For example, if multiple users submit a popular musical query that does not have any matches in the current search database, this unidentified query can show up in Most Popular Searches, where another user can later request a playback of the query tune and name it. In this way the identity of the subject of a past query can become known and the users could be informed of the newly-discovered identity. It would also be possible to provide editorial users and end users with unknown popular musical queries (e.g. on another GUI screen) and ask if the user can identify some of the themes. This information would then be used to add the now known musical themes to the search database. This enables an ever-growing database supported by a collaborative effort of users.

2.3 Other Optional Characterizing Data and Information

In addition to characterizing a musical theme by the relative pitch and duration of each note, other identifying data can also be associated with the characterized theme to further distinguish it from other musical themes, as well as to provided useful information to a user once a matching theme has been found. For example, information such as a theme's genre, country of origin, title, author(s), theme name, key signature, time signature, and so on, can be associated with the theme characterized as described above. This information can be entered by a user as part of a search query to the extent known and added to the musical query as meta-data to assist in the search as will be described shortly. In addition, such meta-data can be included in the database entry associated with each characterized theme that is stored in the search database.

Another optional piece of information that can be associated with a database entry is numeric representations of the "actual pitch" of the first note and the "true musical duration" of shortest note in the theme. This type of data may be used in certain types of searches, however, its main function is to allow the characterized musical theme to be played back to a user without having to access a stored version of the theme (such as a MIDI file), as described previously. Indeed, all information needed for recognizable playback can be generated based on the characterized pitch and duration differences of the notes, given the pitch of the first note and the duration of the shortest note.

Yet another optional information item that can be associated with a database entry is a link to further information about the associated musical theme.

2.4 Musical Theme Searching

A musical theme search is initiated as stated previously, by the user entering a query and instructing that a search be conducted. The query will include the characterized theme entered by the user in the previously-described normalized format. It may also include any of the aforementioned characterizing meta-data if entered by the user. Likewise the musical theme database being searched will have similarly characterized themes and may include whatever meta-data is known about a theme.

Figure 7:
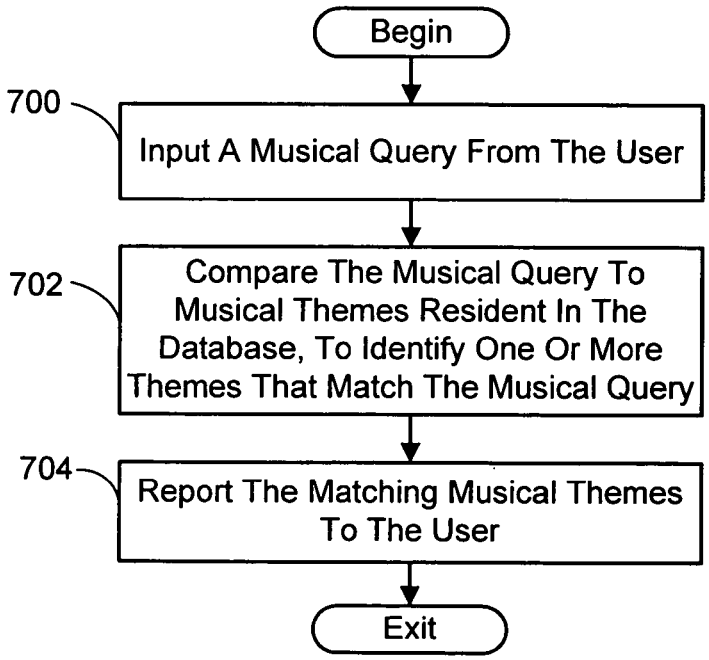
FIG. 7 is a flow chart diagramming a generalized process for musical theme searching.

Thus, referring to FIG. 7, from the perspective of the musical information retrieval system, a musical query is input from the user (process action 700). As stated previously, this musical query will include a sequence of musical notes characterized in the aforementioned normalized format. The system then compares the musical query to musical themes resident in a database, to identify one or more themes that match the musical query (process action 702). These musical themes resident in the database will also include a sequence of musical notes characterized in the normalized format. The system then reports the matching musical themes to the user (process action 704).

The techniques used to identify the matching musical themes and ways in which the results are reported to the user will now be described in more detail in the sections to follow.

2.4.1 Pitch-Based Search Techniques

In one embodiment of the present musical theme search technique, all the database entries having similar pitch patterns are identified first. If a database entry is longer than the search query a match of the entire query to a portion of an entry is acceptable. The matching can entail an exact byte-by-byte matching of the normalized pitch differences. In other words, the integer number pattern of the query exactly matches all or part of an entry in the database. However, the exact match criteria assume the user has entered all the notes of the desired theme accurately. This often may not be the case. Thus, the search can be designed to identify database entries that do not vary from the query by more than some threshold number of bytes (and so notes, in a one-byte-per-note pitch representation). For example, variance of no more than one or two notes would be appropriate for most searches. A big advantage of the normalized representation of relative pitch differences with respect to the first note in the theme is that one wrong note corresponds to just one wrong digital representation. (The special case when the very first note is mismatched can be handled using relative pitch interval technique described below.)

Another type of comparison, by relative pitch interval, can also be performed alone or in combination with the other pitch-based technique. This involves first computing the difference between each consecutive integer in the normalized pitch differences sequence. For example, if the pitch differences sequence of the query or a database entry is 0,0,0,−4,−2,−2,−2,−5 then the relative pitch interval sequence would be 0,0,−4,2,0,0,−3. The relative pitch interval sequence of the query would be compared to the relative pitch interval sequence of the database entries, or at least to those entries identified as possible matches using some other type of comparison. Here again, an exact match can be required, or a match can be declared if all but a prescribed number (e.g., 1 or 2) of integers of the relative pitch interval sequence associated with the query match the relative pitch interval sequence associated with a database entry. This relative pitch interval comparison may find entries when part of the queried theme is transposed into another key or where the very first note of the queried theme is absent or incorrect. It is noted that the aforementioned relative pitch interval sequence associated with either the query or database entries can be computed on-the-fly from the normalized pitch data, or computed ahead of time and added to the characterization information of each musical theme query or database entry. Note that theme matching by relative intervals alone has a disadvantage that one wrong note generally corresponds to two wrong intervals; two wrong notes may correspond to up to four wrong intervals. Thus, combining the interval-matching technique with the aforementioned technique based on pitch differences with respect to first note in the theme would be advantageous.

In another embodiment of the pitch-based search techniques, a full or partial match by rough contour (also known as Parsons code) could be employed alone or in combination with any of the other foregoing techniques. The rough contour can be readily derived on-the-fly from the normalized pitch data associated with a musical query or database entry. Alternately, the contour could be derived beforehand and added to the characterization information of each musical theme query or database entry. Once the contour is derived for both the musical query and the database entry being compared, the comparison is similar to that described previously, although given the more generalized nature of these characterizations, an exact match requirement may produce fewer false matches. To convert the normalized pitch data to the corresponding contour, the value of each integer in the sequence is used to determine if the next note has a higher or lower pitch than the last, skipping the first note.

It is noted that the foregoing pitch-based search techniques could be performed alone or in any desired combination. In addition, each technique can be performed on all the database entries, or alternately, the pitch-based techniques could be performed in any desired sequence with just those database entries identified as matches in the preceding search being considered in the next search.

2.4.2 Rhythm-Based Search Technique

Figure 8:
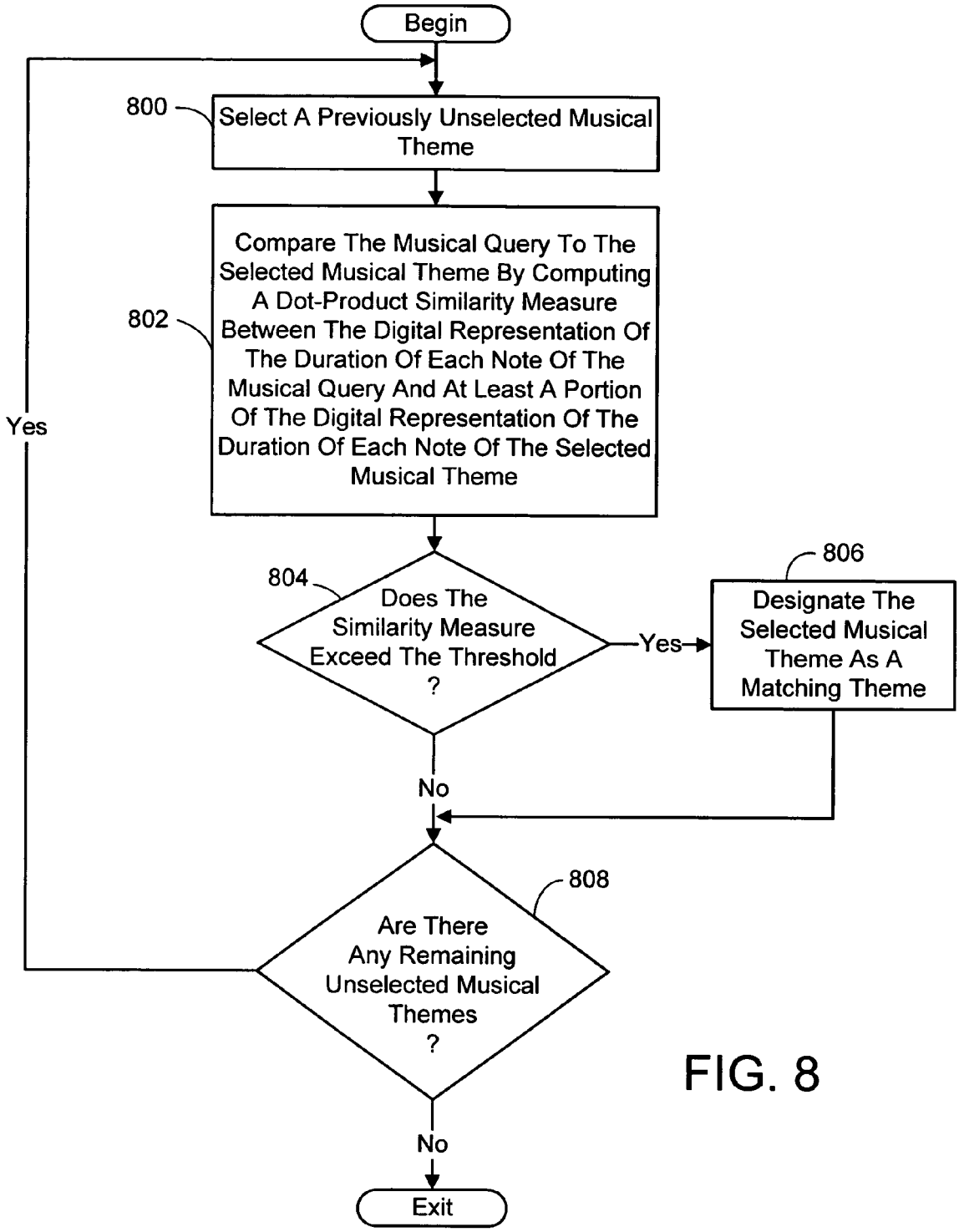
FIG. 8 is a flow chart diagramming one embodiment of a procedure for finding stored musical themes that match the rhythm of a musical query as part of the musical theme searching process.

Once the foregoing pitch-based search techniques are complete, a rhythm-based search technique is performed. The rhythm-based search technique can be applied to all the database entries, or just to those that matched in the pitch-based search. A full or partial byte-by byte matching of the normalized rhythm data between the musical query and the database entries is one possible approach to finding a match, and could be used. However, in tested embodiments, dot-product-based similarity measures for matching the rhythmic patterns were employed. For example, one embodiment of this dot-product-based similarity measurement technique is described in FIG. 8. In this embodiment, a previously unselected musical theme resident in the database is selected (process action 800). As indicated above, the database entry can be chosen from all the entries resident in the database, or restricted to just those declared to be matching by the foregoing pitch-based search technique or techniques. The musical query is compared to the selected musical theme by computing a dot-product similarity measure between the digital representation of the duration of each note of the musical query and at least a portion of the digital representation of the duration of each note of the selected musical theme (process action 802). It is then determined if the computed similarity measure exceeds a prescribed threshold (process action 804). If so, the selected musical theme if designated as being a matching musical theme (process action 806). If it is determined that the computed similarity measure does not exceed the threshold, or if the selected theme has been declared to be a matching theme, it is next determined if there are any remaining unselected musical themes (process action 808). If there are remaining musical themes, then process actions 800 through 808 are repeated until all the desired database entries have been processed, at which time the search ends.

An example of a suitable dot-product-based similarity measurement technique computes the similarity measure as:

$$(s \cdot v_i)/(|s|\ |v_i|) \tag{1}$$

where s is a musical query search vector (e.g., the normalized rhythm data pattern of the musical query), and $v_i$ is a vector stored in the database (e.g., the normalized rhythm data pattern of all or part of a database entry). The greater the similarity measure is, the better the match. As indicated above, a simple threshold can be employed to define whether the computed similarity measure indicates a match. For example, tested embodiments used a threshold value of 0.95; only those themes with similarity greater than the threshold are considered to match the rhythmic pattern of the given query.

It is noted that the rhythm-based search technique could be performed prior to the pitch-based techniques as an alternate embodiment. In that case, the pitch-based techniques could be performed on just those database entries that have been identified as matches in the rhythm-based search. However, experimentation shows that pitch-based matching narrows down the result set more efficiently; and therefore a "pitch first, then rhythm" technique may be more advantageous.

2.4.3 Meta-Data Search Technique

In those cases where the aforementioned meta-data is included in the musical query, it can be used to further refine the search results. Generally, any meta-data included in the query is compared to the meta-data associated with the database entries to identify matching meta-data. Here again, this search can involve all the database entries, or just those identified as possible matches in the pitch-based and rhythm-based search techniques.

It is noted that the meta-data search technique could be performed prior to either the pitch-based or rhythm-based search techniques as an alternate embodiment. In such a case, the pitch-based and/or rhythm-based search techniques could be performed on all the database entries, or just those database entries identified as matches in the meta-data search.

2.4.4 Search Results

Once the desired pitch-based search technique(s), the rhythm-based search technique, and optionally the meta-data search technique have been performed—either no match will have been found, or one or more possible matches will have been identified. In the case where some or all of these search techniques were performed using all the database entries, there may be duplicate matches. The duplicates can be combined in the search results or listed individually as desired.

If no matches are found, this information is reported back to the user making the query. However, if one or more matches are found, information about the matching database entries is provided to the user. The information provided is displayed to the user as discussed previously in connection with the description of the GUI.

It is noted that when more than one possible match is found, there are several ways it can be reported to the user. In one embodiment of the results presentation, the results are provided to the user and displayed as described previously in connection with the description of the GUI in random order regardless of the degree to which the search query matched. In an alternate embodiment, the degree to which the search query matched a database entry is taken into consideration and the search results are provided to the user in the order of the degree to which they matched with the closest matching entries being provided first. In one version of this ranking scheme, those database entries that matched the pitch-based data of the search query exactly would be listed before those entries that matched based on the pitch criteria but not exactly. Next, those database entries that matched the rhythm-based data would be provided. Finally, those database entries that matched based on meta-data would be provided. If more than one piece of information was included in the search query, the database entries that matched all of them would be listed before those that just matched some of them.

It is noted that in the foregoing version of the ranking scheme the same database entry may be provided in the search results more than once. If this is not desired, the duplicates can be combined and listed once—for example in the place the first occurrence of the entry is found.

In an alternate version of the ranking scheme, those database entries found to be a match to the musical query by whatever pitch-based technique or techniques employed, would be designated as candidate matches. Then, the rhythm-based comparison technique would only be performed on the candidate database entries, and only those found to be matching by the rhythm-based technique would be designated as matches.

As described previously in connection with the GUI, the search results provided to the user can optionally include links to other information about a listed musical theme, the actual pitch of the first note of a listed musical theme, and the true duration of the shortest note of a listed musical theme. These items would be included if present in the database entry corresponding to the listed musical theme. Further, this same information can be provided in connection to musical themes listed in the aforementioned most popular searches list.

3.0 Other Embodiments

It should be noted that any or all of the aforementioned alternate embodiments may be used in any combination desired to form additional hybrid embodiments. In addition, although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

Wherefore, what is claimed is:

1. A computer-readable medium having computer-executable instructions for retrieving musical information from a database of musical themes, said computer-executable instructions comprising:

inputting a musical query from a user, said query comprising a sequence of musical notes;

characterizing the melody of the musical query based on a digital representation of the pitch of each note, in such a way that identical pitches within the sequence have the same digital representations, different pitches have different digital representations, and the pitch of the very first note in sequence is represented as a zero;

characterizing the rhythm of the musical query based on a digital representation of the duration of each note;

designating the characterized melody and rhythm of the musical query as a normalized representation of the musical query;

comparing the normalized representation of the musical query to musical themes resident in the database of musical themes to identify one or more themes in the database that match the musical query, wherein each of the musical themes resident in the database comprise a sequence of musical notes characterized as a normalized representation in the same manner as the musical query; and reporting the matching musical themes found in the database to the user.

2. The computer-readable medium of claim 1, wherein the instruction for comparing the normalized representation of the musical query to musical themes resident in the database of musical themes to identify one or more themes in the database that match the musical query comprises instructions for:

determining if an exact byte-by-byte match exists between the digital representation of the pitch of each note of the musical query and at least a portion of the digital representation of the pitch of each note of a musical theme resident in the database, for each musical theme resident in the database;

designating each musical theme resident In the database having said exact byte-by-byte match to the musical query as a matching musical theme.

3. The computer-readable medium of claim 1, wherein the instruction for comparing the normalized representation of the musical query to musical themes resident in the database of musical themes to identify one or more themes in the database that match the musical query comprises instructions for:

determining which bytes of the digital representation of the pitch of each note of the musical query match at least a portion of the digital representation of the pitch of each note of a musical theme resident in the database, for each musical theme resident in the database;

designating those musical themes resident in the database that have no more than a prescribed number of bytes in at least a portion thereof that do not match the bytes of the musical query, as being a matching musical theme.

4. The computer-readable medium of claim 1, wherein the instruction for comparing the normalized representation of the musical query to musical themes resident in the database of musical themes to identify one or more themes in the database that match the musical query comprises instructions for:

computing a dot-product similarity measure between the digital representation of the duration of each note of the musical query and at least a portion of the digital representation of the duration of each note of a musical theme resident in the database, for each musical theme resident in the database;

designating those musical themes resident in the database that have a similarity measure with the musical query that exceeds a prescribed threshold as being a matching musical theme.

5. The computer-readable medium of claim 1, wherein one or more of the musical themes resident in the database further comprises information regarding the musical theme comprising at least one of a musical theme's genre, country of origin, title, author or authors, name, key signature, and time signature and wherein the musical query further comprises at least one of a genre, country of origin, title, author or authors, name, key signature, and time signature of said sequence of musical notes, and wherein the instruction for comparing the normalized representation of the musical query to musical themes resident in the database of musical themes to identify one or more themes in the database that match the musical query comprises an instruction for identifying if said information regarding the musical theme associated with a musical theme resident in the database matches any of such information included in the musical query.

6. The computer-readable medium of claim 1, wherein the instruction for comparing the normalized representation of the musical query to musical themes resident in the database of musical themes to identify one or more themes in the database that match the musical query comprises instructions for:

first, designating a musical theme as matching candidate to the musical query if a match to a prescribed degree exists between the digital representation of the pitch of each note of the musical query and at least a portion of the digital representation of the pitch of each note of the musical theme; and second, designating a musical theme previousiy designated as a matching candidate as matching the musical query if a dot-product similarity measure computed between the digital representation of the duration of each note of the musical query and at least a portion of the digital representation of the duration of each note of the musical theme exceeds a prescribed threshold.

7. The computer-readable medium of claim 1, wherein the instruction for reporting the matching musical themes found in the database to the user, comprises instructions for:

whenever no musical themes in the database are identified that match the musical query, reporting this to the user;

whenever one or more musical themes in the database are identified as matching the musical query, providing information about each matching musical theme to the user.

8. The computer-readable medium of claim 7, wherein the instruction for providing information about each matching musical theme to the user whenever more than musical theme in the database is identified as matching the musical query, comprises an instruction for providing the name of each matching musical theme and providing the names in an order indicative of the degree to which the musical theme matched the musical query with the closest matching musical themes being provided first.

9. The computer-readable medium of claim 8, wherein the instruction for providing the names in an order indicative of the degree to which the musical theme matched the musical query, comprises instructions for:

first, providing the names of musical themes identified as matching the musical query because they exhibit an exact byte-by-byte match between the digital representation of the pitch of each note of the musical query and at least a portion of the digital representation of the pitch of each note of the musical theme;

second, providing the names of musical themes identified as matching the musical query because it is determined that the bytes of the digital representation of the pitch of each note of the musical query match at least a portion of the digital representation of the pitch of each note of the musical theme to the extent that no more than a prescribed number of bytes do not match the bytes of the musical query; and third, providing the names of musical themes identified as matching the musical query because a dot-product similarity measure computed between the digital representation of the duration of each note of the musical query and at least a portion of the digital representation of the duration of each note of the musical theme exceeds a prescribed threshold.

10. The computer-readable medium of claim 9, wherein the instruction for providing the names in an order indicative of the degree to which the musical theme matched the musical query, further comprises an instruction for, lastly, providing the names of musical themes identified as matching the musical query because information regarding the musical theme being sought comprising at least one of a musical theme's genre, country of origin, title, author or authors, name, key signature, and time signature which are included in the musical query match at least one of the identical types of information regarding the musical theme.

11. The computer-readable medium of claim 10, wherein the instruction for providing the names in an order indicative of the degree to which the musical theme matched the musical query, comprises an instruction for, whenever the name of a musical theme is to be provided more than once, providing the name just once.

12. The computer-readable medium of claim 1, wherein each of the musical themes resident in the database further comprises the actual pitch of the first note of the musical theme and the true musical duration of the shortest note in the musical theme, and wherein the instruction for reporting the matching musical themes found in the database to the user, comprises an instruction that uses the actual pitch of the first note and the true musical duration of the shortest note of each matching musical theme for playing back the theme in the correct tempo and key directly from its normalized format, without having to access a separate file comprising a playable version of the musical theme.

13. The computer-readable medium of claim 1, wherein the instruction for characterizing the melody of the musical query, comprises instructions for:

assigning a digital representation of the number zero to the first note of the sequence; and for each note of the sequence after the first note, assigning a digital representation of an integer number signifying the pitch difference of the note under consideration with respect to the first note.

14. The computer-readable medium of claim 13, wherein the instruction for assigning a digital representation of an integer number signifying the pitch difference of the note under consideration with respect to the first note for each note of the sequence after the first note, comprises instructions for:

computing the difference in pitch between the note under consideration and the first note in terms of the number of semi-tones separating said notes;

assigning a digital representation of an integer number equal to the number of semi-tones separating the note under consideration and the first note of the sequence, wherein the integer number is positive whenever the note under consideration has a higher pitch than the first note, the integer number is negative whenever the note under consideration has a lower pitch than the first note, and the integer number is zero whenever the note under consideration has the same pitch as the first note.

15. The computer-readable medium of claim 1, wherein the instruction for characterizing the rhythm of the sequence of musical notes, comprises instructions for:

assigning a digital representation of an integer number signifying the duration of each note of longer duration relative to a note or notes exhibiting the shortest duration in the sequence within a prescribed tolerance; and assigning a digital representation of a base integer number to the shortest duration note or notes, wherein multiples of the base number correspond to the integer number signifying the duration of each of the notes of longer duration.

16. The computer-readable medium of claim 1, wherein the instruction for characterizing the rhythm of the sequence of musical notes, comprises instructions for:

assigning a digital representation of a prescribed base integer number to a note or notes of the sequence exhibiting the shortest duration within a prescribed tolerance; and assigning a digital representation of an integer number to each note having a duration longer than said shortest duration note or notes, which equals the base number multiplied by the ratio of the duration of the note under consideration to the duration of any of said shortest duration note or notes, and rounded to the nearest integer.

17. A computer-implemented process for retrieving musical information from a database of musical themes, comprising using a computer to perform the following process actions:

inputting a musical query from a user, said query comprising a sequence of musical notes;

characterizing the melody of the musical query based on a digital representation of the pitch of each note, in such a way that identical pitches within the sequence have the same digital representations, different pitches have different digital representations, and the pitch of the very first note in sequence is represented as a zero;

characterizing the rhythm of the musical query based on a digital representation of the duration of each note;

designating the characterized melody and rhythm of the musical query as a normalized representation of the musical query;

comparing the normalized representation of the musical query to musical themes resident in the database of musical themes to identify one or more themes in the database that match the musical query, wherein each of the musical themes resident in the database comprise a sequence of musical notes characterized as a normalized representation in the same manner as the musical query; and reporting the matching musical themes found in the database to the user.

18. A system for retrieving musical information from a database of musical themes, comprising:

a general purpose computing device;

a computer program comprising program modules executable by the computing device, wherein the computing device is directed by the program modules of the computer program to, input a musical query from a user, said query comprising a sequence of musical notes, characterize the melody of the musical query based on a digital representation of the pitch of each note, in such a way that identical pitches within the sequence have the same digital representations, different pitches have different digital representations, and the pitch of the very first note in sequence is represented as a zero, characterize the rhythm of the musical query based on a digital representation of the duration of each note, designate the characterized melody and rhythm of the musical query as a normalized representation of the musical query, compare the normalized representation of the musical query to musical themes resident in the database of musical themes to identify one or more themes in the database that match the musical query, wherein each of the musical themes resident in the database comprise a sequence of musical notes characterized as a normalized representation in the same manner as the musical query, and report the matching musical themes found in the database to the user.

* * * * *

UNITED STATES PATENT AND TRADEMARK OFFICE

CERTIFICATE OF CORRECTION

PATENT NO. : 7,518,052 B2
APPLICATION NO. : 11/384061
DATED : April 14, 2009
INVENTOR(S) : Alexei A. Kourbatov It is certified that error appears in the above-identified patent and that said Letters Patent is hereby corrected as shown below:

In column 15, line 1, in Claim 2, delete “In” and insert -- in --, therefor.

In column 15, line 63, in Claim 6, delete “previousiy” and insert -- previously --, therefor.

Signed and Sealed this
Tenth Day of May, 2011

David J. Kappos

David J. Kappos
*Director of the United States Patent and Trademark Office*